US010827822B2

(12) United States Patent
Harrington et al.

(10) Patent No.: US 10,827,822 B2
(45) Date of Patent: Nov. 10, 2020

(54) CLEANING DEVICES HAVING FEEDBACK BETWEEN DIFFERENT CLEANING STATES

(71) Applicant: Unger Marketing International, LLC, Bridgeport, CT (US)

(72) Inventors: William Harrington, Charlestown, RI (US); James M. Buckley, New Hartford, CT (US); Robert F. Smith, Waterbury, CT (US); Paul Adams, Monroe, CT (US)

(73) Assignee: UNGER MARKETING INTERNATIONAL, LLC, Bridgeport, CT (US)

( * ) Notice: Subject to any disclaimer, the term of this patent is extended or adjusted under 35 U.S.C. 154(b) by 426 days.

(21) Appl. No.: 14/668,535

(22) Filed: Mar. 25, 2015

(65) Prior Publication Data

US 2015/0272308 A1 Oct. 1, 2015

Related U.S. Application Data

(63) Continuation-in-part of application No. 29/496,201, filed on Jul. 10, 2014, now Pat. No. Des. 771,392, which is a continuation-in-part of application No. 29/485,955, filed on Mar. 25, 2014, now Pat. No. Des. 744,243, which is a continuation-in-part of application No. 29/485,950, filed on Mar. 25, 2014, (Continued)

(51) Int. Cl.

| | |
|---|---|
| ***A46B 5/00*** | (2006.01) |
| ***A46B 15/00*** | (2006.01) |
| ***A46B 5/02*** | (2006.01) |
| ***A46B 9/06*** | (2006.01) |

(52) U.S. Cl.

CPC ..... *A46B 5/0075* (2013.01); *A46B 5/0054* (2013.01); *A46B 5/0083* (2013.01); *A46B 5/021* (2013.01); *A46B 9/06* (2013.01); *A46B 15/004* (2013.01); *A46B 15/0046* (2013.01)

(58) Field of Classification Search

CPC . A46B 15/004; A46B 15/0046; A46B 5/0054; A46B 5/0075; A46B 5/0083; A46B 5/021; A46B 9/06; A46B 9/02

USPC ..... 15/106, 143.1, DIG. 5

See application file for complete search history.

(56) References Cited

U.S. PATENT DOCUMENTS

| | | | |
|---|---|---|---|
| 1,820,769 | A | 8/1931 | Barker |
| D96,436 | S | 7/1935 | Wewetzer |

(Continued)

FOREIGN PATENT DOCUMENTS

| | | |
|---|---|---|
| CN | 2610834 | 4/2003 |
| DE | 3618823 | 10/1987 |

(Continued)

OTHER PUBLICATIONS

Merriam-Webster definition of "buckle" from https://www.merriam-webster.com/dictionary/buckle (Year: 2018).*

(Continued)

*Primary Examiner* — Douglas Lee

(74) *Attorney, Agent, or Firm* — Cantor Colburn LLP

(57) ABSTRACT

Cleaning devices are provided that have a surface with areas that provide different cleaning states. The areas of different cleaning states are connected to one another by a deflection member that provides tactile and/or audible feedback to the user when transitioning between the different cleaning states.

18 Claims, 9 Drawing Sheets

Related U.S. Application Data now Pat. No. Des. 744,242, which is a continuation-in-part of application No. 29/485,939, filed on Mar. 25, 2014, now Pat. No. Des. 744,760, which is a continuation-in-part of application No. 29/485,938, filed on Mar. 25, 2014, now Pat. No. Des. 743,703.

(56) References Cited

U.S. PATENT DOCUMENTS

| | | | | |
|---|---|---|---|---|
| D104,878 | S | 6/1937 | Rabusen | |
| 2,740,146 | A | 4/1956 | Vaughn | |
| 3,110,053 | A * | 11/1963 | Surabian | A46B 9/10 15/159.1 |
| 3,147,502 | A | 9/1964 | Richards | |
| 3,199,136 | A | 8/1965 | George | |
| 3,656,202 | A | 4/1972 | Paton | |
| 4,197,611 | A | 4/1980 | Bell et al. | |
| D258,861 | S | 4/1981 | Bratton et al. | |
| D269,565 | S | 7/1983 | Goldstaub | |
| 4,721,021 | A | 1/1988 | Kusznir | |
| 4,739,536 | A | 4/1988 | Bandera et al. | |
| D296,946 | S | 7/1988 | Stirling | |
| 4,852,210 | A | 8/1989 | Krajicek | |
| 4,864,675 | A | 9/1989 | Jones | |
| 4,947,504 | A | 8/1990 | Ostwald | |
| 4,974,286 | A | 12/1990 | Stowell et al. | |
| 4,991,250 | A | 2/1991 | Young | |
| D332,734 | S | 1/1993 | Fushiya | |
| D333,239 | S | 2/1993 | Pogue | |
| D354,881 | S | 1/1995 | Huff | |
| 5,390,805 | A | 2/1995 | Bilani et al. | |
| D356,446 | S | 3/1995 | Hoagland | |
| 5,406,667 | A | 4/1995 | Teufel | |
| D361,695 | S | 8/1995 | Sutker | |
| 5,446,941 | A | 9/1995 | Kelsay | |
| D373,506 | S | 9/1996 | Viemeister | |
| 5,625,918 | A | 5/1997 | Kieson et al. | |
| D380,345 | S | 7/1997 | Lu | |
| D384,242 | S | 9/1997 | Ancona et al. | |
| D389,698 | S | 1/1998 | Cohen et al. | |
| D396,168 | S | 7/1998 | Cohen et al. | |
| D399,388 | S | 10/1998 | Cohen et al. | |
| 5,848,451 | A | 12/1998 | Barnett | |
| 5,857,241 | A | 1/1999 | Camp, Jr. et al. | |
| D406,491 | S | 3/1999 | Cohen et al. | |
| 5,896,613 | A | 4/1999 | Courtney | |
| D411,410 | S | 6/1999 | Pedrini | |
| 5,943,727 | A | 8/1999 | Freer | |
| 5,964,009 | A | 10/1999 | Hoepfl et al. | |
| D429,136 | S | 8/2000 | Ali | |
| D431,753 | S | 10/2000 | Cohen | |
| D437,095 | S | 1/2001 | Osiecki | |
| RE37,190 | E | 5/2001 | Stowell et al. | |
| 6,237,193 | B1 | 5/2001 | Skerker et al. | |
| 6,256,828 | B1 | 7/2001 | Sauer | |
| D446,025 | S | 8/2001 | Petner | |
| 6,273,626 | B1 | 8/2001 | Yazawa | |
| D448,176 | S | 9/2001 | Petner | |
| D449,451 | S | 10/2001 | Petner | |
| 6,352,662 | B1 | 3/2002 | Murphy et al. | |
| D461,058 | S | 8/2002 | Hay | |
| 6,633,309 | B2 | 10/2003 | Lau et al. | |
| D500,600 | S | 1/2005 | Hay et al. | |
| D500,927 | S | 1/2005 | Hay | |
| D502,002 | S | 2/2005 | Conway et al. | |
| D502,324 | S | 3/2005 | Conway et al. | |
| D508,631 | S | 8/2005 | Cuillery | |
| D509,991 | S | 9/2005 | Costello et al. | |
| D520,852 | S | 5/2006 | Minkler et al. | |
| 7,115,172 | B1 | 10/2006 | Teodorovich | |
| D534,725 | S | 1/2007 | Vu | |
| 7,257,853 | B2 | 8/2007 | Boyer et al. | |
| D553,907 | S | 10/2007 | Catalano et al. | |
| D554,315 | S | 10/2007 | Schouten | |
| D554,817 | S | 11/2007 | Talesfore et al. | |
| D556,408 | S | 11/2007 | Lang | |
| D557,084 | S | 12/2007 | Yamanaka et al. | |
| 7,310,845 | B2 | 12/2007 | Gilli | |
| D562,011 | S | 2/2008 | Meyer | |
| D562,516 | S | 2/2008 | Talesfore et al. | |
| D577,871 | S | 9/2008 | Caserta | |
| 7,429,707 | B2 | 9/2008 | Yanai et al. | |
| 7,469,441 | B2 | 12/2008 | Hirse | |
| D584,061 | S | 1/2009 | Meyer | |
| D586,877 | S | 2/2009 | Li | |
| D586,962 | S | 2/2009 | Li | |
| D591,956 | S | 5/2009 | Treacy | |
| D594,274 | S | 6/2009 | McKenzie | |
| D601,351 | S | 10/2009 | Wales | |
| D602,697 | S | 10/2009 | Chitayat | |
| D606,320 | S | 12/2009 | Meyer | |
| D607,169 | S | 12/2009 | Weis et al. | |
| D607,297 | S | 1/2010 | Ali | |
| D609,921 | S | 2/2010 | Lee | |
| 7,674,418 | B2 | 3/2010 | Matsumoto et al. | |
| D616,649 | S | 6/2010 | Lin | |
| 7,779,501 | B2 | 8/2010 | Lacotta et al. | |
| D624,264 | S | 9/2010 | Li | |
| D630,888 | S | 1/2011 | Bodum | |
| D643,221 | S | 8/2011 | Gates | |
| D644,030 | S | 8/2011 | Gates | |
| D647,703 | S | 11/2011 | Li | |
| D650,955 | S | 12/2011 | Chapman et al. | |
| D660,600 | S | 5/2012 | Pottes | |
| 8,215,945 | B2 | 7/2012 | Matsumoto et al. | |
| D678,611 | S | 3/2013 | Hsu | |
| D688,465 | S | 8/2013 | Khubani | |
| D694,021 | S | 11/2013 | Weaver et al. | |
| D697,314 | S | 1/2014 | Tronconi et al. | |
| D697,317 | S | 1/2014 | Schouten et al. | |
| 9,049,973 | B1 | 6/2015 | Arrieta | |
| D743,703 | S | 11/2015 | Harrington et al. | |
| D744,243 | S | 12/2015 | Harrington | |
| D744,760 | S | 12/2015 | Harrington et al. | |
| D753,399 | S | 4/2016 | Owen et al. | |
| D753,722 | S | 4/2016 | Mariet et al. | |
| D757,442 | S | 5/2016 | Waitesmith | |
| D764,179 | S | 8/2016 | Odunsi | |
| D771,392 | S | 11/2016 | Harrington et al. | |
| D777,448 | S | 1/2017 | Saputo et al. | |
| D782,197 | S | 3/2017 | Kern et al. | |
| D814,805 | S | 4/2018 | Hwang | |
| D817,006 | S | 5/2018 | Kinoshita | |
| D834,333 | S | 11/2018 | Krus | |
| 2004/0231700 | A1 | 11/2004 | Bell et al. | |
| 2006/0018706 | A1 | 1/2006 | Bensussan et al. | |
| 2006/0070196 | A1 | 4/2006 | Lacotta et al. | |
| 2007/0177930 | A1 | 8/2007 | Byun | |
| 2008/0040876 | A1 | 2/2008 | Aiyar | |
| 2008/0120799 | A1 | 5/2008 | Dondi et al. | |
| 2008/0155769 | A1* | 7/2008 | Schonewille | A47L 13/26 15/21.1 |
| 2008/0172816 | A1 | 7/2008 | Zhadanov | |
| 2012/0204369 | A1 | 8/2012 | Watanabe et al. | |
| 2014/0311524 | A1* | 10/2014 | Call | A47L 13/12 134/6 |
| 2015/0296968 | A1 | 10/2015 | Hwang | |

FOREIGN PATENT DOCUMENTS

| | | |
|---|---|---|
| EP | 0370697 | 11/1989 |
| EP | 0370698 | 11/1989 |
| EP | 1188406 | 3/2002 |
| GB | 1286784 | 8/1972 |
| JP | 1217028 | 9/2004 |
| KR | 20140069865 | 6/2014 |
| WO | 9740736 | 11/1997 |

OTHER PUBLICATIONS

Printout of the Unger Dual-Action Dish Brush 978760 from the Home Depot website at https://www.homedepot.com/p/Unger-Dual-Action-Dish-Brush-978760/300240910) (Year: 2019).*

(56) References Cited

OTHER PUBLICATIONS

Unger Ultimate . . . the authority in clean. Dish Brush. Kitchen Brush. Pot & Pan Brush. Nov. 6, 2014. pp. 5-7.
Unger Ultimate . . . the authority in clean. True Grip Palm Brush with Blue Scrub-Zone Technology. Jul. 10, 2014. p. 12.

* cited by examiner

CLEANING DEVICES HAVING FEEDBACK BETWEEN DIFFERENT CLEANING STATES

CROSS REFERENCE TO RELATED APPLICATIONS

This application is a continuation of U.S. application Ser. No. 29/485,938 filed Mar. 25, 2014, is a continuation of U.S. application Ser. No. 29/485,939 filed Mar. 25, 2014, is a continuation of U.S. application Ser. No. 29/485,950 filed Mar. 25, 2014, is a continuation of U.S. application Ser. No. 29/485,955 filed Mar. 25, 2014, and is a continuation of U.S. application Ser. No. 29/496,201 filed Jul. 10, 2014, the entire contents of each of which are incorporated by reference herein.

BACKGROUND OF THE INVENTION

1. Field of the Invention

The present disclosure relates to cleaning devices having multiple cleaning states. More particularly, the present disclosure relates to cleaning devices having feedback between the different cleaning states.

2. Description of Related Art

Many different types of cleaning devices have been developed for cleaning floors, windows, floors, walls, and other surfaces. Some prior art cleaning devices can include areas that allow the device to clean one surface with a first cleaning state, but clean other surfaces with a second, different cleaning state. As used herein the term "cleaning state" shall include an attribute such as, but not limited to, abrasiveness, liquid absorption, cleaning pressure, dusting, scrubbing, and any combinations thereof.

For example and in a very basic form, some prior art cleaning devices are reversible—where one side provides a first cleaning state and the opposite side has a second cleaning state. Here, the state change between the first and second cleaning states is achieved by simply turning the cleaning device (e.g., sponge, mop pad, etc.) over.

However in more complex cleaning devices, such as that disclosed by Applicant's own U.S. Pat. No. 7,779,501, the contents of which are incorporated by reference herein, the transition between different cleaning states is accomplished by way of a hinged area.

It has been determined by the present disclosure that there is a need for cleaning devices that provide tactile and/or audible feedback to the user when the device changes between the different cleaning states. Accordingly, the present disclosure provides cleaning devices that overcome and/or mitigate one or more of the aforementioned drawbacks and deficiencies of prior cleaning devices.

SUMMARY

Cleaning devices are provided that have a surface with areas that provide different cleaning states. The areas of different cleaning states are connected to one another by a deflection member that provides feedback to the user when transitioning between the different cleaning states.

A cleaning device for cleaning a surface to be cleaned is provided. The cleaning device includes a first member having a first cleaning surface; a second member having a second cleaning surface; and a deflection member securing the first and second members to one another. The deflection member deflects between a first cleaning state in which at least the first cleaning surface is in contact with the surface to be cleaned and a third cleaning state in which at least the second cleaning surface is in contact with the surface to be cleaned. The deflection member provides feedback to a user when transitioning to and/or from at least one of the first cleaning state and the third cleaning state.

In some embodiments alone or in combination with the afore or aft mentioned embodiments, the cleaning device can include a second cleaning state in which the first and second cleaning surfaces are in contact with the surface to be cleaned.

In some embodiments alone or in combination with the afore or aft mentioned embodiments, the feedback can be tactile and/or audible.

In some embodiments alone or in combination with the afore or aft mentioned embodiments, the first cleaning surface can be soft brush bristles and the second cleaning surface can be hard brush bristles.

In some embodiments alone or in combination with the afore or aft mentioned embodiments, the second cleaning surface, when in the first cleaning state, is recessed with respect to the first cleaning surface so that only the first cleaning surface is in contact with the surface to be cleaned. Here, the deflection member can provides tactile feedback when transitioning to and/or from the first cleaning state.

In some embodiments alone or in combination with the afore or aft mentioned embodiments, the first and second cleaning surfaces, when in the second cleaning state, are coplanar so that both the first and second cleaning surfaces are in contact with the surface to be cleaned. Here, the deflection member can provide tactile feedback when transitioning to and/or from the second cleaning state.

In some embodiments alone or in combination with the afore or aft mentioned embodiments, the first cleaning surface, when in the third cleaning state, is recessed with respect to the second cleaning surface so that only the second cleaning surface is in contact with the surface to be cleaned. Here, the deflection member can provide tactile feedback when transitioning to and/or from the third cleaning state.

In some embodiments alone or in combination with the afore or aft mentioned embodiments, the deflection member has at least one arm having a concave dome shape, a first hinge or fulcrum point connected to the first member, and a second hinge of fulcrum point connected to the second member.

In some embodiments alone or in combination with the afore or aft mentioned embodiments, the deflection member has two arms with a concave dome shape, a first hinge or fulcrum point connected to the first member, a second hinge of fulcrum point connected to the second member, and a third hinge or fulcrum point connecting the two arms.

In some embodiments alone or in combination with the afore or aft mentioned embodiments, the first member, the second member, and the deflection member are a unitary, one-piece construction. Here, the first member, the second member, and the deflection member can be co-molded. Alternately, the deflection member can be over-molded on the first and/or second members.

In some embodiments alone or in combination with the afore or aft mentioned embodiments, the deflection member is removably connected to at least one of the first and second member.

In some embodiments alone or in combination with the afore or aft mentioned embodiments, the first cleaning surface is a unitary, one piece construction with the first member or is removably connected with the first member and/or the second cleaning surface is a unitary, one piece construction with the second member or is removably connected with the second member.

In some embodiments alone or in combination with the afore or aft mentioned embodiments, the cleaning device further includes a handle secured to the second member. The handle can be a palm grip handle, an extension handle, an extension pole, or a non-extension pole.

In some embodiments alone or in combination with the afore or aft mentioned embodiments, the deflection member resiliently returns the deflection member to the first cleaning state upon removal of a cleaning force.

In some embodiments alone or in combination with the afore or aft mentioned embodiments, the deflection member returns the deflection member to the first cleaning state upon application of a return force.

A method of cleaning a surface to be cleaned is also provided. The method includes: applying a first force to a cleaning device so that the cleaning device is in a first cleaning state with at least a first cleaning surface in contact with the surface to be cleaned; applying a second force to the cleaning device so that a portion of the cleaning device transitions from the first cleaning state to a different cleaning state with at least a second cleaning surface in contact with the surface to be cleaned; and providing tactile and/or audible feedback when transitioning to and/or from the first cleaning state and/or when transitioning to and/or from the different cleaning state.

The above-described and other features and advantages of the present disclosure will be appreciated and understood by those skilled in the art from the following detailed description, drawings, and appended claims.

DETAILED DESCRIPTION OF THE INVENTION

Figure 1:
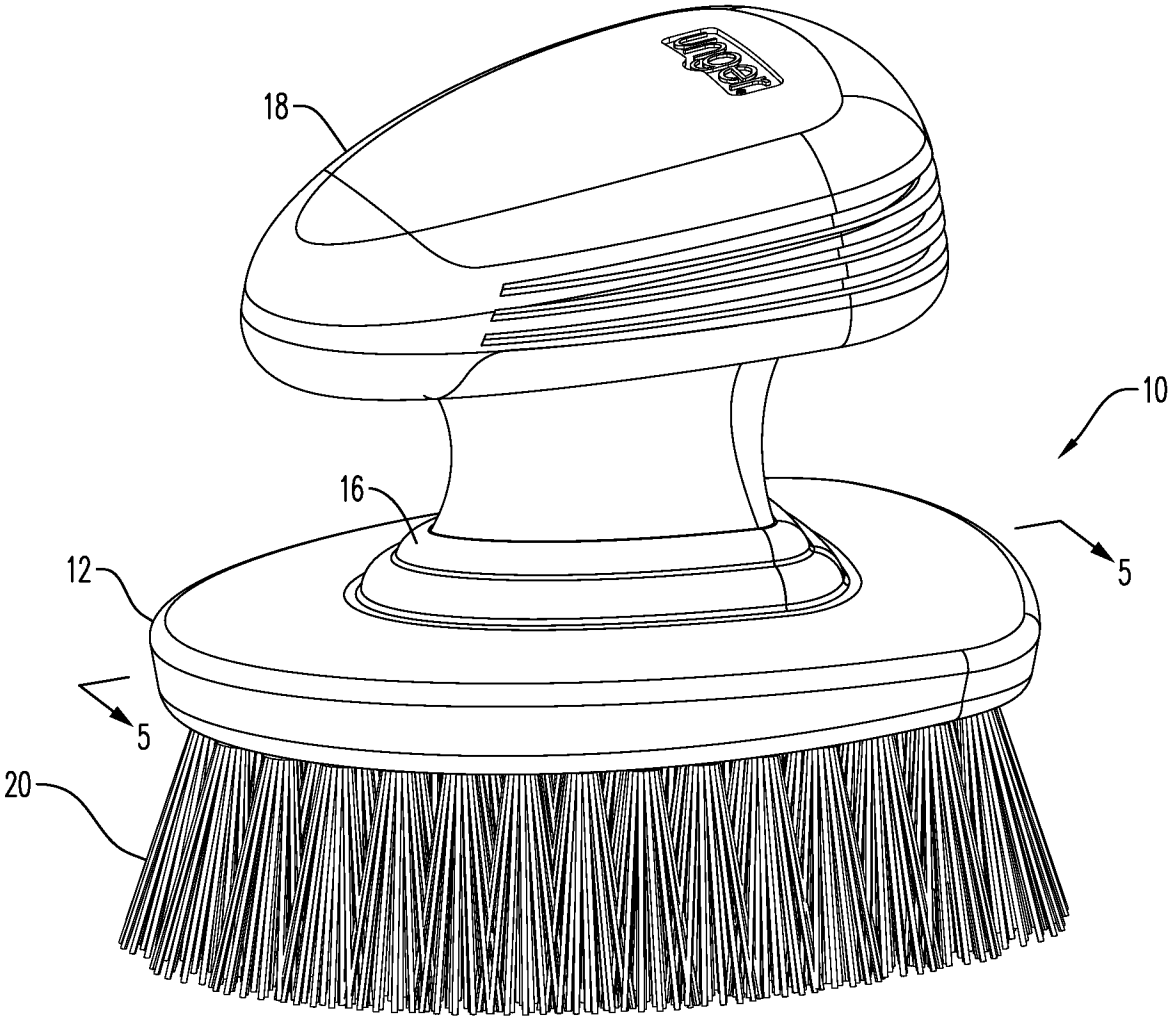
FIG. 1 is a top perspective view of an exemplary embodiment of a cleaning device according to the present disclosure having a palm grip handle.
Figure 2:
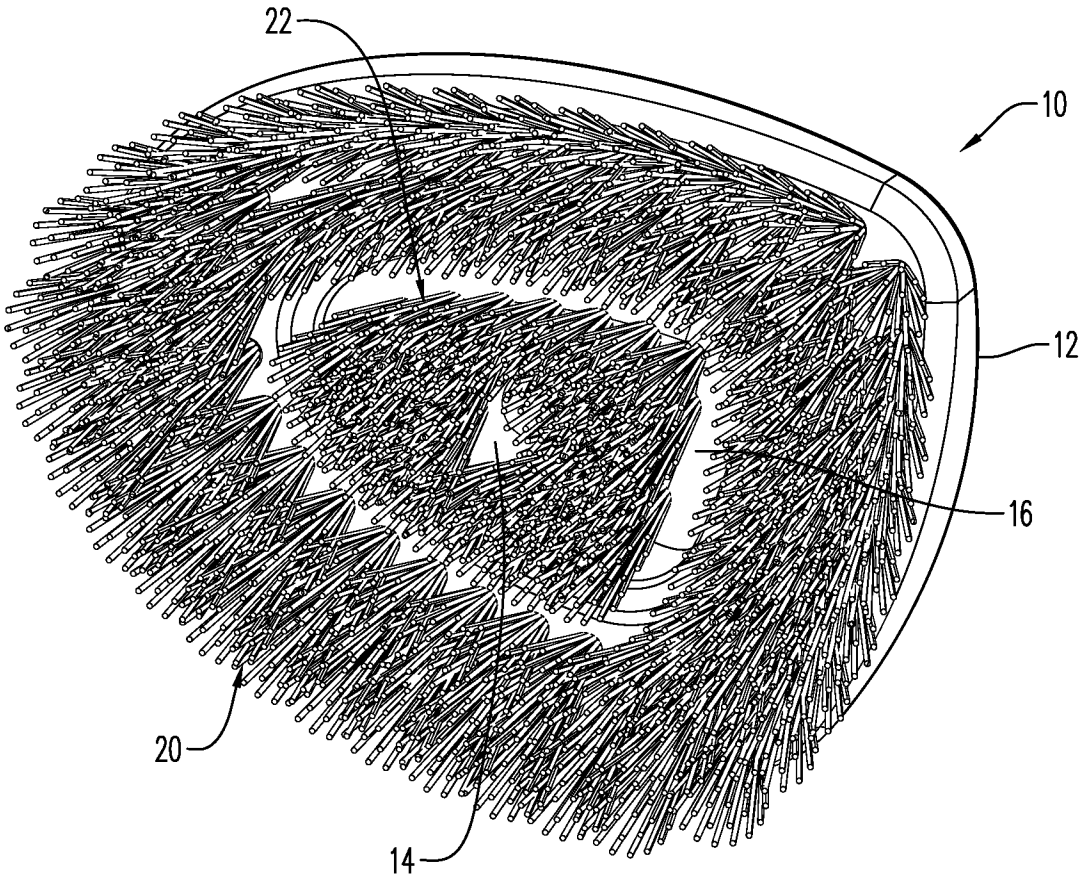
FIG. 2 is a bottom perspective view of the cleaning device of FIG. 1.
Figure 3:
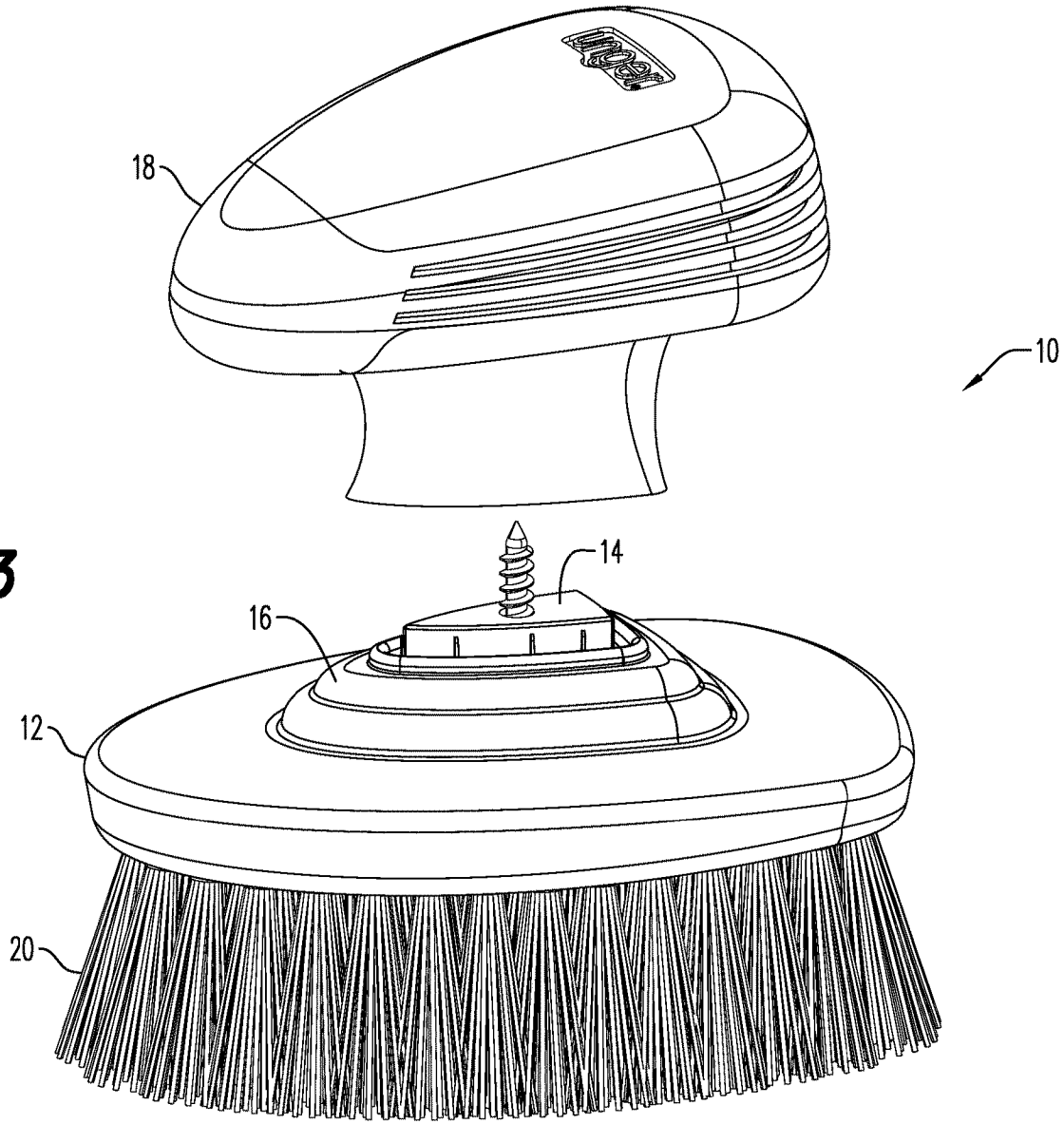
FIG. 3 is a first partially exploded view of the cleaning device and handle of FIG. 1.

Referring to the drawings and in particular to FIGS. 1-2, an exemplary embodiment of a cleaning device according to the present disclosure is generally referred to by reference number 10. Cleaning device 10 includes a first member 12 and a second member 14 connected to one another by a deflection member 16.

Cleaning device 10 is provided with a first cleaning state (e.g., soft brush bristles) by first member 12 and with a second cleaning state (e.g., hard brush bristles) by second member 14. Advantageously, deflection member 16 provides feedback to the user when transitioning between the different cleaning states. The feedback can be tactile, namely felt by the user through contact with cleaning device 10, or can be audible, namely heard by the user, or both. Additionally, the feedback can be present when moving from the first cleaning state to the third cleaning state, from the third cleaning state to the first cleaning state, or both, and any state therebetween.

The general operation of cleaning device 10 is described in more detail with simultaneous reference to FIGS. 1-6. Here, cleaning device 10 is shown connected to a handle 18 in the form of a palm grip.

First member 12 includes a first cleaning surface 20, which is illustrated as soft brush bristles. Second member 14 includes a second cleaning surface 22, which is illustrated as having hard brush bristles.

Figure 5A:
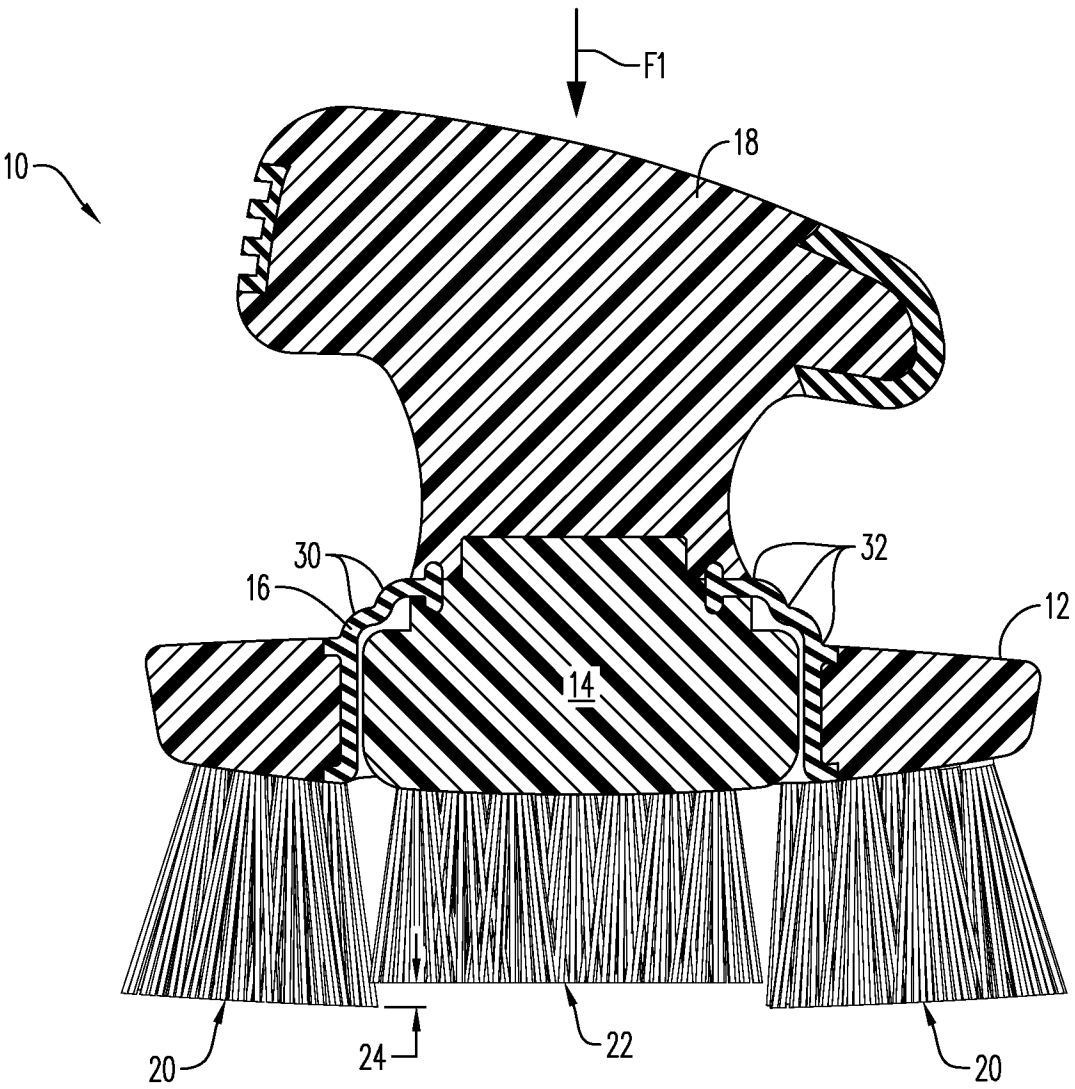
FIGS. 5*a* and 5*b* are sectional views of the cleaning device of FIG. 1 in a first use position or cleaning state (the first "cleaning state")
Figure 5B:
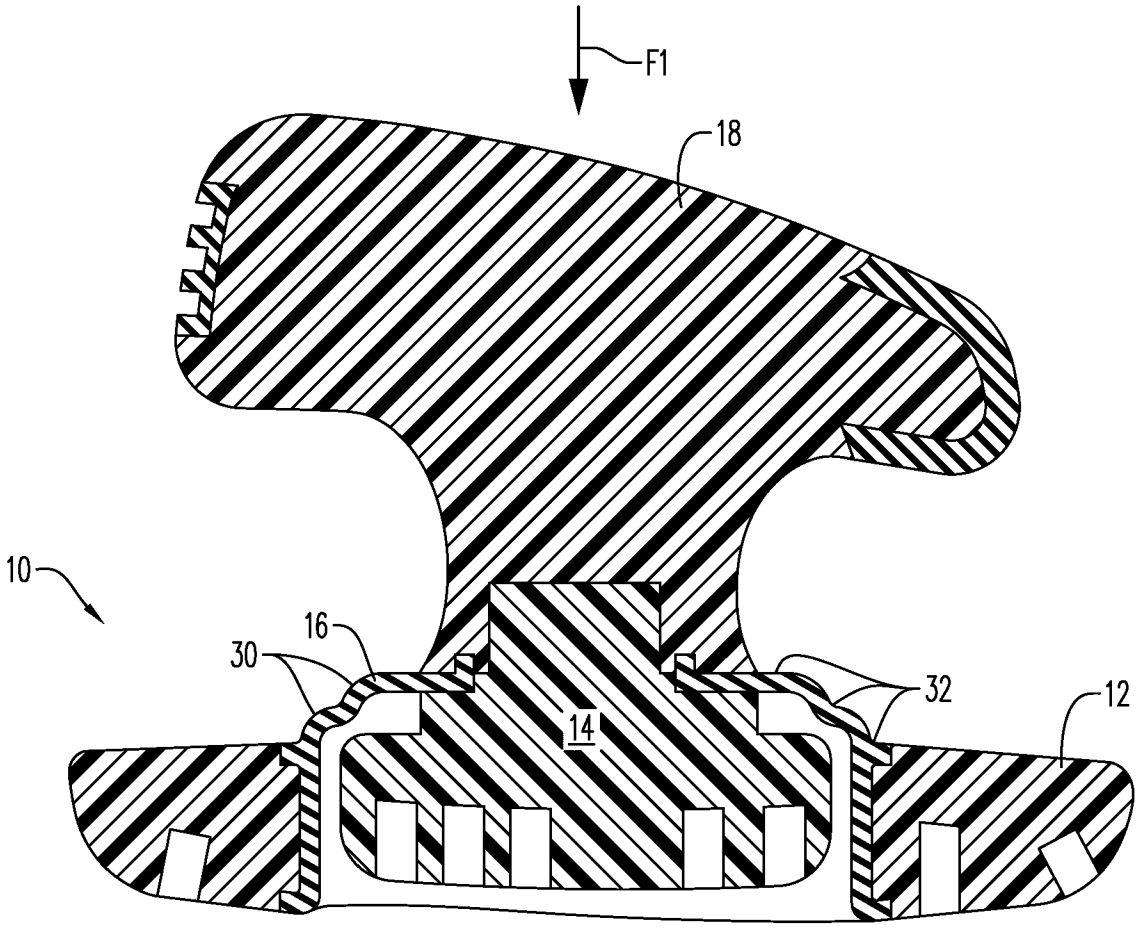

Deflection member 16 secures first member 12 and second member 14 so that second cleaning surface 22 is recessed by a distance 24 with respect to first cleaning surface 20 in a first cleaning state (FIGS. 5*a* and 5*b*). In some embodiments, distance 24 can be about 2-10 millimeters (mm) so that second cleaning surface 22 is recessed with respect to first cleaning surface 20. Of course, it is contemplated by the present disclosure for distance 24 to be larger or smaller depending on factors such as, but not limited to, the particular application of cleaning device 10.

Figure 6:
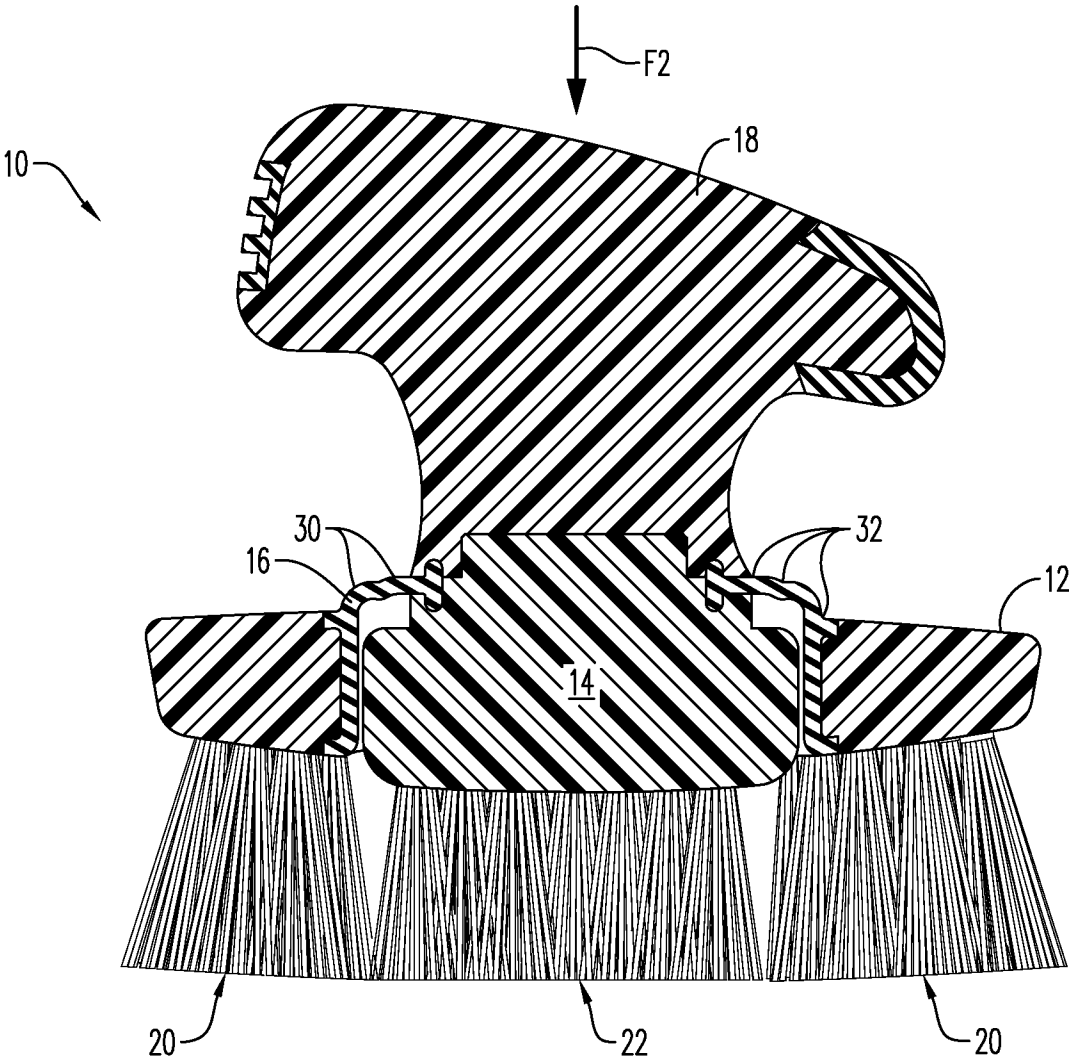
FIG. 6 is a sectional view of the cleaning device of FIG. 1 in a second, intermediate use position or cleaning state (the "second cleaning state")

Deflection member 16 also secures first member 12 and second member 14 so that first cleaning surface 20 is flush or planer with respect to second cleaning surface 22 in a second cleaning state (FIG. 6).

Figure 7:
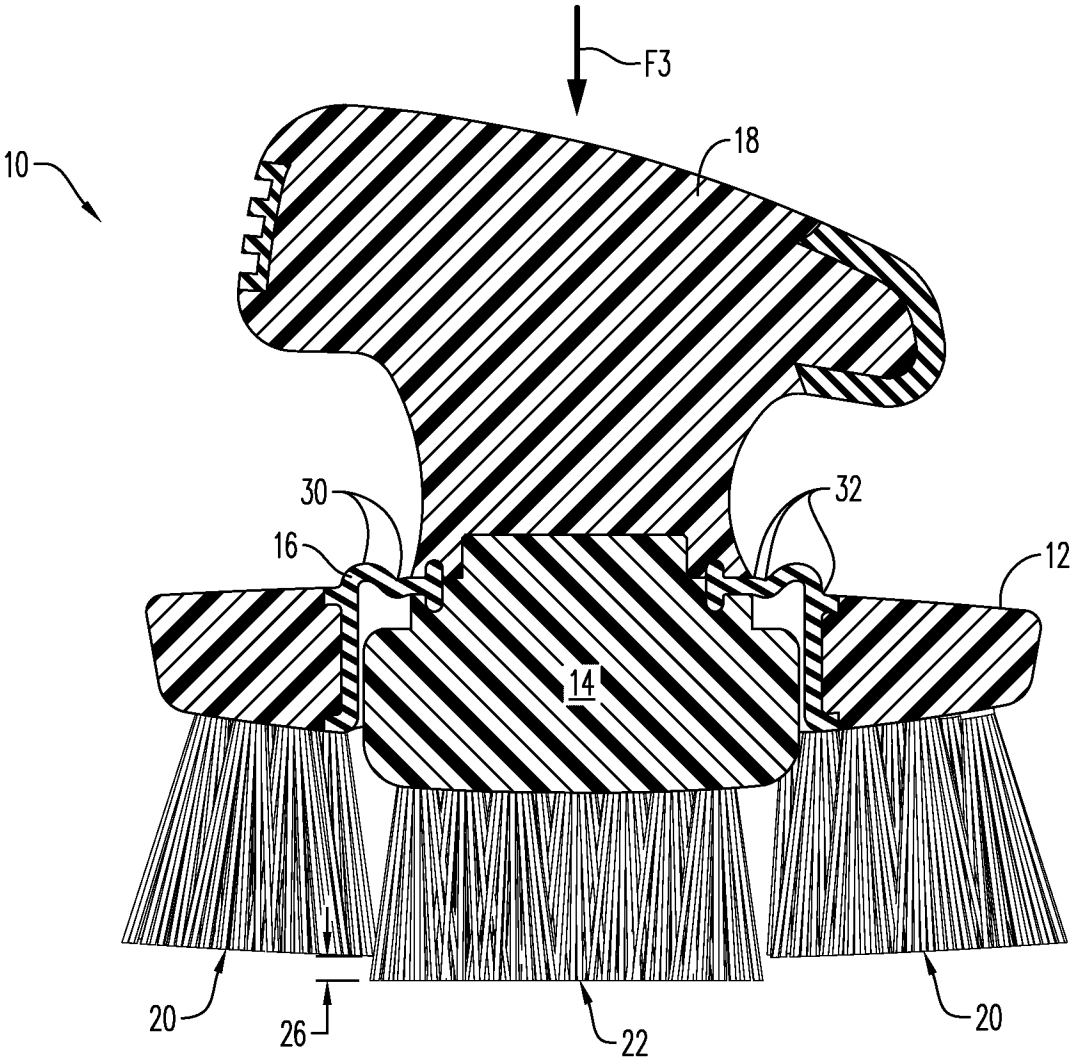
FIG. 7 is a sectional view of the cleaning device of FIG. 1 in a third use position or cleaning state (the third "cleaning state")

Additionally, deflection member 16 secures first member 12 and second member 14 so that first cleaning surface 20 is recessed by a distance 26 with respect to second cleaning surface 22 in a third cleaning state (FIG. 7). In some embodiments, distance 26 can be about 2-10 millimeters (mm) so that first cleaning surface 20 is recessed with respect to second cleaning surface 22. Of course, it is contemplated by the present disclosure for distance 26 to be larger or smaller depending on factors such as, but not limited to, the particular application of cleaning device 10.

In the first cleaning state of FIGS. 5*a* and 5*b* in which deflection member 16 has not been deflected, cleaning device 10 is configured so that only first cleaning surface 20 of first member 12 is in contact with the surface being cleaned. In the second cleaning state of FIG. 6 in which deflection member 16 has been partially deflected, cleaning device 10 is configured so that both first and second cleaning surfaces 20, 22 are in contact with the surface being cleaned. However, in the third cleaning state of FIG. 7 in which deflection member 16 has been further deflected, cleaning device 10 is configured so that only second cleaning surface 22 of second member 14 is in contact with the surface being cleaned.

In this manner, first and second members 12, 14 provide cleaning device 10 with different cleaning states depending upon whether only first cleaning surface 20 is in contact with the surface to be cleaned, only second cleaning surface 22 is in contact with the surface to be cleaned, or whether both first and second cleaning surfaces 20, 22 are in contact with the surface to be cleaned.

Cleaning device 10 transitions between the various cleaning states depending on the amount of downward force (F) applied to handle 18. Thus, a user can apply a low downward force (F1) when the first cleaning state of FIGS. 5*a* and 5*b* is desired, can apply a medium downward force (F2) when the second cleaning state of FIG. 6 is desired, and can apply a highest downward force (F3) when the second cleaning state of FIG. 7 is desired.

The forces (F1, F2, F3) necessary to transition cleaning device 10 among the cleaning states can be configured by, for example, the choice of materials (e.g., durometer), the dimensions (e.g., thicknesses and lengths), and structure of one or more of first cleaning surface 20, second cleaning surface 22, and deflection member 16.

By way of example only, it is contemplated by the present disclosure for cleaning device 10 to be configured with deflection member 16 that provides feedback at the forces (F1, F2, F3) that correspond to the desired use of the cleaning device. In embodiments where cleaning device 10 is a hand tool, deflection member 16 is configured to move among the cleaning states and provide the desired feedback at the lower forces (F1, F2, F3) that are commensurate with such hand tools. In contrast, in embodiments where cleaning device 10 is used with an extension pole, deflection member 16 is configured to move among the cleaning states and provide the desired feedback at the higher forces (F1, F2, F3) that are commensurate with the torque applied by such extension poles.

It should be recognized that cleaning device 10 is illustrated as configured with first cleaning surface 20 of first member 12 in contact with the surface being cleaned in the first position and second cleaning surface 22 of second member 14 in contact with the surface being cleaned in the second position. Of course, it is contemplated by the present disclosure for the operation of cleaning device 10 be reversed from that shown. Here, first cleaning surface 20 can normally be in contact with the surface to be cleaned, while second cleaning surface 22 can be placed into contact with the surface to be cleaned upon deflection of deflection member 16. In this embodiment, handle 18 is secured to first member 12.

It has been determined by the present disclosure that there is a desire for device 10 to provide feedback to the user as to when the device transitions between one or more of the different cleaning states. Accordingly, deflection member 16 is configured to provide the desired feedback at any point when transitioning between the different cleaning states.

Figure 4:
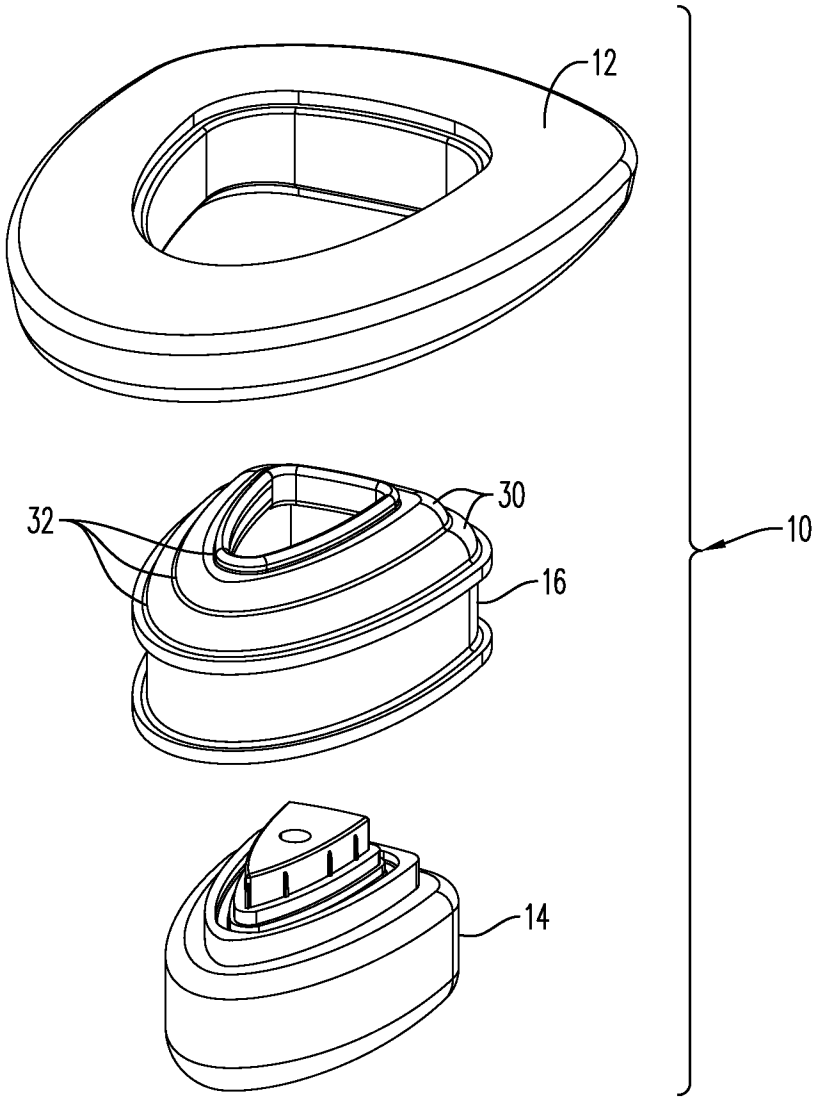
FIG. 4 is a second partially exploded view of the cleaning device of FIG. 1 having various components omitted for clarity.

Deflection member 16 is described in more detail with simultaneous reference to FIGS. 4 and 7.

Deflection member 16 is a unitary or one piece elastomeric member and is formed of any material having sufficient flexibility and resiliency to provide the feedback to cleaning device 10. For example, deflection member can be formed of thermoplastic elastomer (TPE), rubber, foam, polyvinyl chloride (PVC), polypropylene (PP), thermoplastics, and others.

In some embodiments, deflection member 16 is overmolded or co-molded with first and second members 12, 14 so that cleaning device 10 forms a unitary or one piece device. In other embodiments, deflection member 16 is separate member that is secured to, removably or permanently, to first and/or second members 12, 14. By way of example only, it is contemplated by the present disclosure for cleaning device 10 to be made as an injection molded part, an extruded part, an assembly of parts that are secured to one another, and as a single part—where members 12, 14, and 16 are all formed as one part from the same material with the deflection member having one or more thickness and/or durometer that allow for the aforementioned deflection, resiliency, and feedback.

Deflection member 16 includes at least one arm 30 that defines a hinge or fulcrum point 32 at each end of the arm. In the illustrated embodiment, deflection member 16 includes two arms 30, namely upper and lower arms, which define three points 32. Of course, it is contemplated by the present disclosure for deflection member 16 to have any desired number of arms 30.

Arms 30 have a normally concave shape with respect to the surface being cleaned as seen in FIGS. 5*a* and 5*b* during application of the downward cleaning force (F1) to provide the first cleaning state.

However, during application of the downward cleaning force (F2) of FIG. 6 the resiliency of deflection member 16 results in arms 30 elastically bending and/or pivoting about points 32 to provide the second cleaning state. Preferably, deflection member 16 is configured to resiliently return, upon reducing or releasing of the cleaning force (F2), to the normal concave shape of FIGS. 5*a* and 5*b*.

Once the downward cleaning force (F3) is sufficiently large, arms 30 elastically bend and/or pivot to an "over center" position where the arms buckle or invert to have a convex shape (or at least a flattened shape) with respect to the surface being cleaned as seen in FIG. 7 to provide the third cleaning state. Without wishing to be bound by any particular theory, it is believes that deflection member 16 undergoes snap-through buckling at a point where force (F3) is above the critical load of the member—such that the member undergoes a large deformation by snapping into a different (e.g., inverted) configuration.

It should be recognized that cleaning device 10 is described above by way of example only as imparting forces (F1, F2, F3) sufficient to transition deflection member 16 among the cleaning states as a result of forces on handle 18 on the surface to be cleaned. Of course, it is contemplated by the present disclosure for cleaning device 10 to be manually operated without pressing the cleaning device on the surface to be cleaned.

Preferably, deflection member 16 is configured to resiliently unbuckle or revert, upon reducing or releasing of the cleaning force (F3), to the non-inverted shapes of FIGS. 5*a*, 5*b*, and 6. Of course, it is also contemplated by the present disclosure for deflection member 16 to remain in the third cleaning state of FIG. 7 until a force opposite in direction to F3 is applied to cleaning device 10.

Without wishing to be bound by any particular theory, the buckling/unbuckling or inversion/reversion of arms 30 between concave-and-convex and back is believed to provide cleaning device 10 with the feedback when changing between cleaning states.

In some embodiments, cleaning device 10 is configured to provide no feedback when moving between the first cleaning state of FIGS. 5*a*, 5*b* and the second cleaning state of FIG. 6. Specifically, deflection member 16 can be configured to move between the first and second cleaning state without inversion/reversion of the concave shape of arms 30, but rather to rely upon the flexion of the arms and pivoting around points 32.

In other embodiments, cleaning device 10 is configured to provide feedback when moving between the first cleaning state of FIGS. 5*a*, 5*b* and the second cleaning state of FIG. 6. Here, deflection member 16 can be configured to move between the first and second cleaning states by inverting/reverting the concave shape of only one of arms 30. In this embodiment, deflection member 16 is further configured to move between the second and third cleaning states by inverting/reverting the concave shape of the other of arms 30.

Additionally, it is believed that the inversion/reversion of arms 30 between concave-and-convex and back provide cleaning device 10 with the ability to recess second cleaning surface 22 with respect to first cleaning surface 20 in the first cleaning state of FIGS. 5*a*, 5*b* and to recess first cleaning surface 20 with respect to second cleaning surface 22 in the second cleaning state of FIG. 7.

For example, the inversion of arm 30 from concave (FIGS. 5*a*, 5*b*) to convex (FIG. 7) results in deflection member 16 pulling first cleaning surface 20 up away from the surface being cleaned. Conversely, the inversion of arm 30 from convex (FIG. 7) to concave (FIGS. 5*a*, 5*b*) results in deflection member 16 returning first cleaning surface 20 into contact with the surface being cleaned.

While deflection member 16 has been described above by way of example as resiliently returning to the cleaning state of FIGS. 5*a* and 5*b* upon the removal or reduction of the downward cleaning forces (F2, F3), it is also contemplated by the present disclosure for the deflection member to be configured so that a return force—in a direction opposite to the downward cleaning force—needs to be applied to return arms 30 to the normal concave shape.

Cleaning device 10 is described above for purposes of clarity as having first and second surfaces 20, 22 recessed with respect to one another in the first and second cleaning states of FIGS. 5*a*, 5*b*, and 6, respectively, by distances 24, 26. However, it is contemplated by the present disclosure for the feedback of deflection member 16 to be provided independent of distances 24, 26. Thus, cleaning device 10 can be configured to provide the feedback from deflection member 16 when first and second surfaces 20, 22 are co-planar (i.e., distances 24, 26 equal to zero) to one another in the first cleaning state, the second cleaning state, or both.

Cleaning device 10 is also described above as being provided with the first cleaning state by first member 12 due to soft brush bristles and with the second cleaning state by second member 14 due to hard brush bristles. Of course, it is contemplated by the present disclosure for the different cleaning states to be provided simply by a concentrated pressure area available at second member 14 resulting from the pressure applied by handle 18 to second member 14.

Cleaning device 10 is described above as being provided with cleaning surfaces in the form of brush bristles that are formed as unitary, one-piece constructions with the first and second members 12, 14. Of course, it is contemplated by the present disclosure for one or both of cleaning surfaces 20, 22 to be removably connected to first and second members 12, 14, respectively.

Stated another way, it is contemplated by the present disclosure for namely for first and second cleaning surfaces 20, 22 to be made of the same material (e.g., both soft brush bristles), to be made of similar materials of differing cleaning attributes (e.g., soft and hard brush bristles), or to be made of different materials (e.g., brush bristles and sponge mop). Thus, it is contemplated by the present disclosure for cleaning device 10 to find equal use with cleaning surfaces 20, 22 such as, but not limited to, brush bristles, dust mops, sponge mops, microfiber mops, scraper blades, foam mops, melamine foam, and any combinations thereof.

Figure 8:
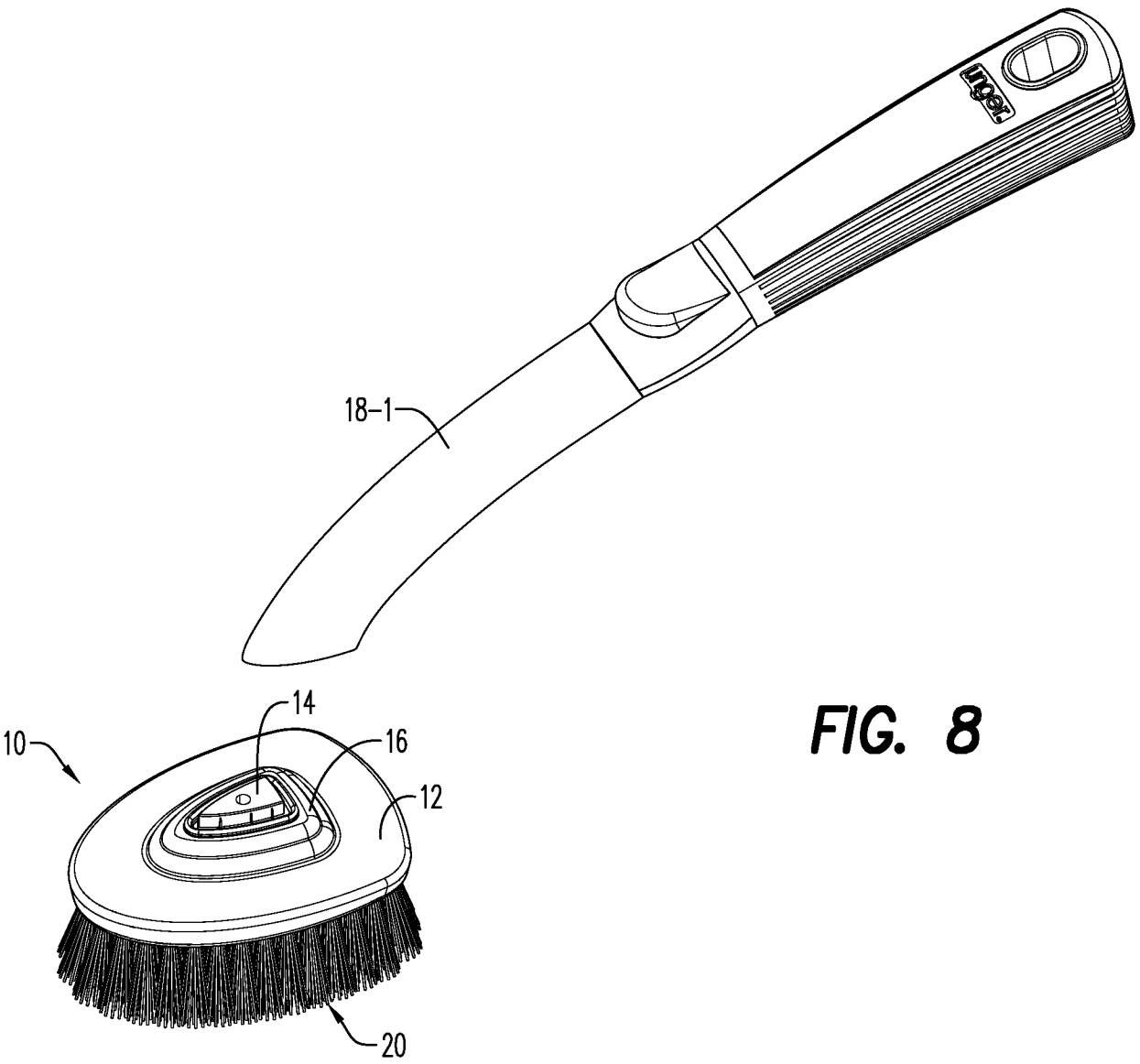
FIG. 8 is a first partially exploded view of the cleaning device of FIG. 1 having an alternate exemplary embodiment of a handle.

Further, cleaning device 10 is illustrated and described with respect to FIGS. 1-7 in use with handle 18 in the form of a palm grip. However, it is contemplated by the present disclosure for cleaning device 10 to find equal use with other handles such as, but not limited to, an elongated handle 18-1 as shown in FIG. 8, an extension pole (not shown), a non-extension pole, and any combinations thereof. Further, it is contemplated by the present disclosure for cleaning device 10 to be removably connected to handle 18, 18-1 and/or for the cleaning device to be connected to the handle via a universal joint (not shown).

Advantageously, cleaning device 10 can be configured—by adjusting first and second cleaning surfaces 20, 22—for use in dry mopping, wet mopping, dust mopping, sweeping, brushing, dusting, scraping, wiping, scrubbing, squeegeeing, and any combinations thereof. Stated another way, cleaning device 10 can be configured as a broom, a mop, a flat mop, scraper, a microfiber floor cleaner, a microfiber window cleaner, a duster, a squeegee, and any combinations thereof.

It should also be noted that the terms "first", "second", "third", "upper", "lower", "inner", "outer", and the like may be used herein to modify various elements. These modifiers do not imply a spatial, sequential, or hierarchical order to the modified elements unless specifically stated.

While the present disclosure has been described with reference to one or more exemplary embodiments, it will be understood by those skilled in the art that various changes may be made and equivalents may be substituted for elements thereof without departing from the scope of the present disclosure. In addition, many modifications may be made to adapt a particular situation or material to the teachings of the disclosure without departing from the scope thereof. Therefore, it is intended that the present disclosure not be limited to the particular embodiment(s) disclosed as the best mode contemplated, but that the disclosure will include all embodiments falling within the scope of the appended claims.

What is claimed is:

1. A cleaning device for cleaning a surface to be cleaned, comprising:

a first member having a first cleaning surface;

a second member having a second cleaning surface; and a deflection member directly coupled between the first and second members, the deflection member being deflectable between a first cleaning state in which at least the first cleaning surface is in contact with the surface to be cleaned and a third cleaning state in which at least the second cleaning surface is in contact with the surface to be cleaned, the deflection member having at least one arm that extends between the first member and the second member and the deflection member defines a shape that inverts to provide feedback to a user when transitioning between at least one of the first cleaning state and the third cleaning state, wherein the at least one arm defines a first fulcrum point between the at least one arm and the first member and a second fulcrum point between the at least one arm and the second member, wherein the first and second members pivot relative to each other about the first and second fulcrum points, wherein, when in the first cleaning state, the second cleaning surface is recessed with respect to the first cleaning surface so that only the first cleaning surface is in contact with the surface to be cleaned, and wherein, when in the third cleaning state, the first cleaning surface is recessed with respect to the second cleaning surface so that only the second cleaning surface is in contact with the surface to be cleaned.

2. The cleaning device of claim 1, further comprising a second cleaning state in which the first and second cleaning surfaces are in contact with the surface to be cleaned.

3. The cleaning device of claim 2, wherein, when in the second cleaning state, the first and second cleaning surfaces are coplanar so that both the first and second cleaning surfaces are in contact with the surface to be cleaned.

4. The cleaning device of claim 1, wherein the feedback is tactile and/or audible.

5. The cleaning device of claim 1, wherein the first cleaning surface comprises soft brush bristles and the second cleaning surface comprises hard brush bristles.

6. The cleaning device of claim 1, wherein the deflection member provides tactile feedback when transitioning to and/or from the first cleaning state.

7. The cleaning device of claim 1, herein the deflection member provides tactile feedback when transitioning to and/or from the second cleaning state.

8. The cleaning device of claim 1, wherein the deflection member provides tactile feedback when transitioning to and/or from the third cleaning state.

9. The cleaning device of claim 1, wherein the first member, the second member, and the deflection member are a unitary, one-piece construction.

10. The cleaning device of claim 9, wherein the first member, the second member, and the deflection member are co-molded.

11. The cleaning device of claim 1, wherein the deflection member is removably connected to at least one of the first and second member.

12. The cleaning device of claim 1, wherein the first cleaning surface is a unitary, one piece construction with the first member or is removably connected with the first member and/or the second cleaning surface is a unitary, one piece construction with the second member or is removably connected with the second member.

13. The cleaning device of claim 1, further comprising a handle secured to the second member.

14. The cleaning device of claim 13, wherein the handle is selected from the group consisting of a palm grip handle, an extension handle, an extension pole, and a non-extension pole.

15. The cleaning device of claim 1, wherein the deflection member resiliently returns the deflection member to the first cleaning state upon removal of a cleaning force.

16. The cleaning device of claim 1, wherein the deflection member has a concave shape that inverts into an at least partially convex or flattened shape to provide the feedback to the user.

17. A cleaning device for cleaning a surface to be cleaned, comprising:

a handle having a base portion;

a first member coupled to the base portion, the first member having a first cleaning surface;

a deflection member coupled to the handle and having a portion extending from and about at least a portion of a periphery of the base portion, the deflection member having a first shape when a first force is applied to the handle and deforming to a second shape when a second force is applied to the handle; and a second member coupled to the deflection member, the second member having a second cleaning surface, wherein the deflection member comprises at least one arm that defines a first fulcrum point between the at least one arm and the first member and a second fulcrum point between the at least one arm and the second member, wherein the first and second members pivot relative to each other about the first and second fulcrum points, wherein, when in the first cleaning state, the second cleaning surface is recessed with respect to the first cleaning surface so that only the first cleaning surface is in contact with the surface to be cleaned, and wherein, when in the third cleaning state, the first cleaning surface is recessed with respect to the second cleaning surface so that only the second cleaning surface is in contact with the surface to be cleaned.

18. The cleaning device of claim 17, wherein the deflection member returns to the first shape when the second force is removed.

* * * * *